United States Patent [19]

Altamore

[11] Patent Number: 4,782,592

[45] Date of Patent: Nov. 8, 1988

[54] METHODS AND APPARATUS FOR CLIPPING HAIR

[75] Inventor: Nicolo Altamore, Rockford, Ill.

[73] Assignee: Wahl Clipper Corporation, Sterling, Ill.

[21] Appl. No.: 9,761

[22] Filed: Feb. 2, 1987

Related U.S. Application Data

[63] Continuation-in-part of Ser. No. 796,307, Nov. 8, 1985, abandoned.

[51] Int. Cl.[4] ..... B26B 19/00

[52] U.S. Cl. ..... 30/195; 30/223

[58] Field of Search ..... 30/223, 225, 226, 197, 30/204, 195

[56] References Cited

U.S. PATENT DOCUMENTS

| | | |
|---|---|---|
| 1,395,104 | 10/1921 | Gray . |
| 1,780,276 | 11/1930 | Scheiwer . |
| 1,791,228 | 2/1931 | Scheiwer . |
| 1,908,385 | 5/1933 | Wahl . |
| 2,083,359 | 6/1937 | Branch . |
| 2,199,299 | 4/1940 | Womack . |
| 2,214,069 | 9/1940 | Sikora . |
| 2,292,364 | 8/1942 | Cromonic . |
| 2,470,287 | 5/1949 | Carter . |
| 2,641,833 | 6/1953 | Need . |
| 2,726,441 | 12/1955 | Brody . |
| 2,790,283 | 4/1957 | Spencer . |
| 3,391,459 | 7/1968 | Rollo . |
| 3,571,928 | 3/1971 | Willey et al. . |
| 4,118,863 | 10/1978 | Sandy . |
| 4,221,049 | 9/1980 | Hamashima . |

FOREIGN PATENT DOCUMENTS

| | | |
|---|---|---|
| 1070960 | 5/1958 | Fed. Rep. of Germany . |
| 2007575 | 5/1979 | United Kingdom . |

*Primary Examiner*—E. R. Kazenske
*Assistant Examiner*—Willmon Fridie, Jr.
*Attorney, Agent, or Firm*—Welsh & Katz, Ltd.

[57] ABSTRACT

An electric hair clipper is disclosed which has a plurality of spaced cutting teeth. With this clipper, hair strands may be cut by passing the hair clipper over the hair in a series of swift, flowing strokes. The clipper may be passed over the hair at the outer periphery of the hair, or it may be passed over the hair within the periphery, to change the hair style. The hair clipper may also be used to thin or layer hair. In one such method of thinning or layering hair, the operator passes a comb through the hair in a swift stroke, creating a trough in the hair behind the comb. The hair clipper follows the comb in the trough, cutting hair strands which are displaced by the comb as the hair returns to its natural position. If desired, the clipper can be passed through the hair at an angle away from the scalp, so that the hair strands are cut different lengths. In another method of thinning or layering the hair, the hair clipper is passed through the hair at various depths beneath the outer periphery of the head without using a comb. Both methods may be used to thin or layer hair without producing distinct, differentiated layers, while creating a natural, fluffy hair texture.

1 Claim, 4 Drawing Sheets

METHODS AND APPARATUS FOR CLIPPING HAIR

BACKGROUND OF THE INVENTION

This application is a continuation-in-part of parent application Ser. No. 796,307, filed Nov. 8, 1985 now abandoned.

This invention relates to methods and apparatus for clipping hair, and more particularly, to methods and apparatus for trimming, thinning and layering hair with electric hair clippers.

Most electric hair clippers include two blades. One blade is stationary, and the other blade oscillates with respect to the stationary blade. Each blade has a row of pointed hair cutting teeth, and the two rows of teeth are arranged parallel to and in contact with each other. The tips of the teeth on the stationary blade form a generally straight blade edge.

The teeth are arranged to form generally V-shaped cavities between adjacent teeth. Hair strands which enter the cavities between the teeth on the stationary blade are cut by the oscillating motion of the teeth on the reciprocating blade.

Such hair clippers cut hair easily and effciently across the entire blade edge of the hair clipper. Mistakes can be made easily, however, because the clippers cut many hair strands at one time. In addition, it is difficult to merely trim the hair lightly without leaving visible signs of where the hair was trimmed.

Some hair styling is done with shearing scissors. Such scissors have notched blades so that hair is only cut along selected portions of the blades, and is not cut along the notched portions. As a result, only a predetermined percentage of the hair strands between the blades is cut at any one time.

Shearing scissors may be used to layer hair or thin it, but are generally not used for trimming. Layering or thinning hair with shearing scissors is tedious and time-consuming, and requires a high level of skill. Also, the resulting layers of hair are often distinct and differentiated because all of the hair strands in the hair cutting portions of the blades are cut essentially the same length. Such distinct layers are often visible even when the desire is to merely thin the hair without layering it.

Hair can be thinned or layered with specially adapted electric clippers in which only the hair strands between selected teeth of the stationary blade are cut by the motion of the reciprocating blade. As suggested in U.S. Pat. No. 2,470,287, this may be accomplished by making the cavities between the selected stationary teeth deeper than the cavities between unselected stationary teeth, and moving the reciprocating blade and the blade edge away from each other so that the reciprocating blade only cuts hair in cavities between selected teeth, and not in cavities between unselected teeth. A great number of hair strands which are not intended to be cut pass however, and can be torn or otherwise damaged. Such torn or damaged hair strands may eventually break off or split at the ends. The likelihood of such damage occurring is increased if the clipper moves through the hair quickly.

Another concern with such specially adapted hair clippers is that in order to only cut hair which is in cavities between selected stationary teeth, the selected cavities are made deeper than the cavities which are not selected so that the reciprocating blade may be drawn back to only pass across the selected teeth. As a result, the hair must enter a substantially deeper cavity to be cut, which is undesirable because the operator must move the clipper closer to the head in some circumstances. Since the tips of the blade teeth are hard and relatively sharp, the deep cavities increase the risk of injury in the event that the teeth strike or scrape the skin.

U.S. Pat. No. 4,221,049 discloses a hair clipper which may be used to thin hair. The devices disclosed have spaced pairs of stationary teeth which form notches, and a reciprocating tooth which passes over each notch during operation. It has been found, however, that such configurations do not produce thinning which is as fine and as well controlled as is at times desired. Increasing the distance between the spaced pairs of stationary teeth, and perhaps eliminating one or more pairs of such teeth, is expected to result in less even trimming. Thus, there is a need for new and improved electric hair clippers which are adapted for use in trimming, thinning and layering hair quickly, without creating distinct layers.

Shaping hair is somewhat difficult with conventional scissors and conventional electric clippers because they are designed to remove a substantial number of hair strands at a time. As a result, it is easy to cut hair too short without realizing it. Consequently, there is also a need for apparatus and methods for shaping hair gradually, to permit inspection of the style and shape of the hair throughout the process.

The texture or feeling of cut hair is very important to most people. Known methods and apparatus for cutting hair cut so many strands of hair the same length that the texture of the hair is often coarse and unnatural, and unlike the natural texture of the hair after it grows for a period of time following a haircut. Thus, there is a need for methods and apparatus for cutting hair which create a natural, relatively fluffy, filigreed texture.

The proper use of both shearing scissors and electric hair clippers requires skill, and a person's appearance can easily be ruined if the scissors or clippers are not used properly. One reason for many of the commonly occurring mistakes is that a significant number of strands of hair may be cut at a time, as previously described. Thus, there is a need for methods and apparatus for cutting hair which do not easily ruin a person's appearance if not used properly.

Spiking or notching hair is a popular technique used to create certain hair styles. The technique is difficult to use with scissors and is relatively timeconsuming. Therefore, there is a need for methods and apparatus for spiking or notching hair which are easy to use and are relatively fast.

Accordingly, one object of this invention is to provide new and improved methods and apparatus for clipping hair.

Another object is to provide new and improved methods and apparatus for layering and thinning hair which do not produce distinct, differentiated layers of hair when such layers are not desired.

Still another object is to provide new and improved methods and apparatus for trimming hair which are not excessively tedious and time-consuming, and do not require a high level of skill.

Yet another object is to provide new and improved methods and apparatus for trimming hair which produce a natural texture.

A still further object is to provide new and improved methods and apparatus for trimming hair which do not excessively tear or otherwise damage hair strands which are not cut.

Still another object is to provide new and improved methods and apparatus for trimming hair which are relatively safe and do not require that hair strands which are to be cut enter unusually deep grooves.

Another object is to provide new and improved methods and apparatus for spiking or notching hair which are relatively fast and easy to use.

An additional object is to provide new and improved methods and apparatus for shaping hair gradually, to permit inspection of the style and shape of the hair throughout the process.

SUMMARY OF THE INVENTION

In keeping with one aspect of this invention, an electric hair clipper is disclosed which has a stationary blade and a reciprocating blade. The stationary blade has a plurality of stationary teeth which are arranged in a row. The stationary teeth have relatively blunt tips which form a line called a blade edge, and each stationary tooth has at least one cutting edge which forms an angle with the blade edge. The stationary teeth are arranged in a plurality of groups of one or more teeth, and each group of teeth is spaced apart from each other group. Each group is separated from each other group by a smooth and unobstructed space which has a width at the blade edge which is greater than the distance between the tips of adjacent stationary teeth.

The reciprocating blade has a plurality of reciprocating teeth arranged in a row. The reciprocating teeth are generally complementary to the stationary teeth, and each reciprocating tooth has at least one cutting edge which reciprocates past at least one cutting edge of a stationary tooth which the reciprocating blade tooth complements. The reciprocating blade teeth are arranged in clusters of one or more teeth, and have gaps between clusters.

Hair strands may be cut by passing the hair clipper over the hair in a series of swift, flowing strokes. The clipper may be passed over the hair at the outer periphery of the hair, or it may be passed over the hair within the periphery to change the hair style. The hair style may be changed gradually using the swift stroke method just described, without drastically changing the style with any single pass. In this manner, the hair may be slowly sculpted into a desired hair style, and the hair style may be inspected easily as it is created.

The hair clipper just described may also be used to thin or layer hair. In one method of thinning or layering hair, the operator passes a comb through the hair in a swift, usually upward, stroke, creating a trough in the hair which follows the comb. The hair clipper passes through the hair in the trough behind the comb, cutting some of the hair which is displaced by the comb as the hair returns to its natural position. If desired, the clipper can be passed through the hair at an angle to the scalp, so that the hair strands are cut different lengths.

In another method of thinning or layering the hair, the hair clipper is passed through the hair at various depths beneath the outer periphery of the head without using a comb. Both methods may be used to thin or layer hair without producing distinct, differentiated layers, while creating a natural, fluffy hair texture.

The hair clipper may also be used to create notches in the hair by holding a tuft of hair firmly in one hand, and using the other hand to spike the hair with the clipper. If two teeth are provided in each group of stationary teeth, one or more fairly distinct notches can be created relatively easily and quickly to produce a desired hairstyle. If only one tooth is provided, relatively bland notches will be created, resulting in a hairstyle having a different, softer appearance.

BRIEF DESCRIPTION OF THE DRAWINGS

The above mentioned objects and other features of this invention and the manner of obtaining them will become more apparent, and the invention itself will be best understood by reference to the following detailed description, taken in conjunction with the accompanying drawings, in which.

DETAILED DESCRIPTION

Figure 1:
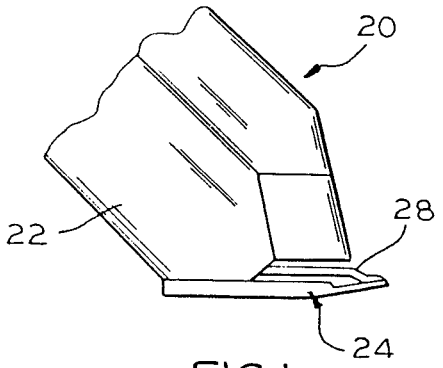
FIG. 1 is a side elevation view of a portion of an electric hair clipper made in accordance with the principles of this invention.
Figure 2:
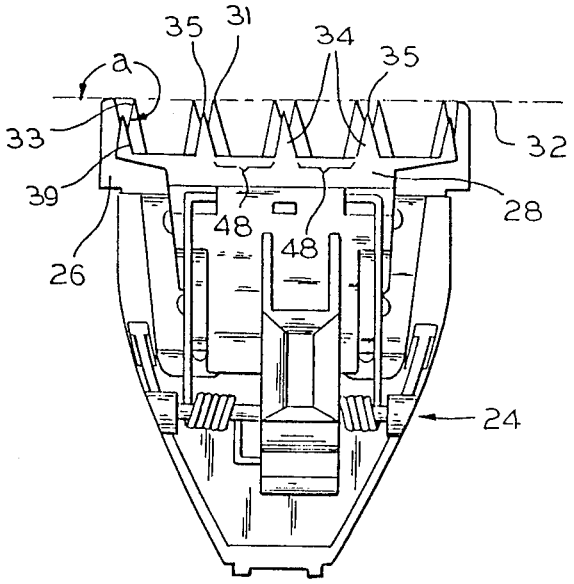
FIG. 2 is a top plan view of the cutting head of the hair clipper of FIG. 1, showing the reciprocating blade in the center of the head.

As seen in FIG. 1, a hair clipper 20 includes a handle 22 (partially shown) and a cutting head 24. The handle 22 includes an internal power source, such as batteries, or a line cord or the like for connection to an external power source. The handle 22 also includes an electric motor and drive means (not shown) operatively connected to the cutting head 24. The cutting head 24 includes a stationary blade 26 which is secured to the handle 22 by any suitable means, such as screws or the like (not shown), and a reciprocating blade 28 which oscillates with respect to the stationary blade 26 during operation.

One embodiment of the cutting head 24 is shown in greater detail in FIGS. 2–6. The stationary blade 26 has a set of stationary teeth 30 (FIG. 5) arranged in a row, and the stationary teeth 30 have stationary tips 31 which define a line 32, referred to herein as the blade edge. The blade edge 32 is preferably substantially straight. The stationary tips 31 are preferably relatively blunt to reduce the likelihood of injury in the event that the teeth come in contact with skin. The stationary tips 31 may have a rounded or flattened end, or any other unpointed shape. The stationary teeth 30 also include at least one cutting edge 33 (FIGS. 2 and 8) which forms an angle "a" with the blade edge 32. The angle "a" may be 90°, but is preferably less than 90°.

The reciprocating blade 28 (FIG. 2) has a set of reciprocating teeth 34 having reciprocating tips 35. The reciprocating tips 35 define a line 37 which is preferably slightly recessed from the stationary tips 31 (FIG. 5), so that if the stationary tips 31 come in direct contact with skin, the oscillating teeth 34 do not contact the skin and possibly irritate it or cut it. The distance between the blade edge 32 and the line 37 is not great, however, so that hair strands do not have to enter deep cavities in order to be cut, and so that the operator can clip the hair close to the skin, if desired. A preferred recess of the line 37 from the blade edge 32 is between about 0.015 inches and 0.020 inches.

Figure 5:
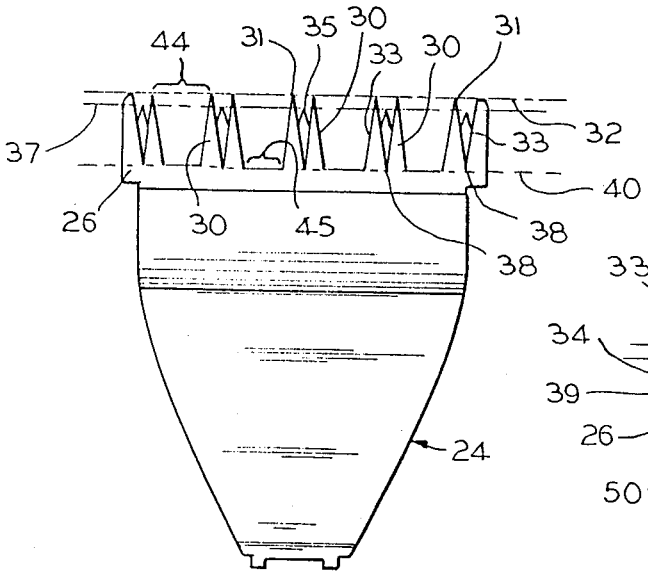
FIG. 5 is a bottom plan view of the cutting head of the hair clipper of FIG. 1.

The reciprocating teeth 34 (FIG. 2) are generally complementary to the stationary teeth 30, and have cutting edges 39 which reciprocate past at least one edge 33 on the stationary blade 26. The reciprocating teeth 34, in combination with the stationary teeth 30, cut hair which enters a plurality of cavities 36 (FIG. 3) between adjacent stationary teeth 30. The cavities 36 are generally V-shaped or U-shaped, and end at a vertex 38 (FIG. 5). The vertexes 38 of the various cavities 36 define a line 40 which is spaced from and generally parallel to the blade edge 32. The distance between the blade edge 32 and the line 40 is preferably relatively small, on the order of 0.1 inches or less. A preferred distance between the blade edge 32 and the line 40 is about 0.090 inches or less.

Figure 7:
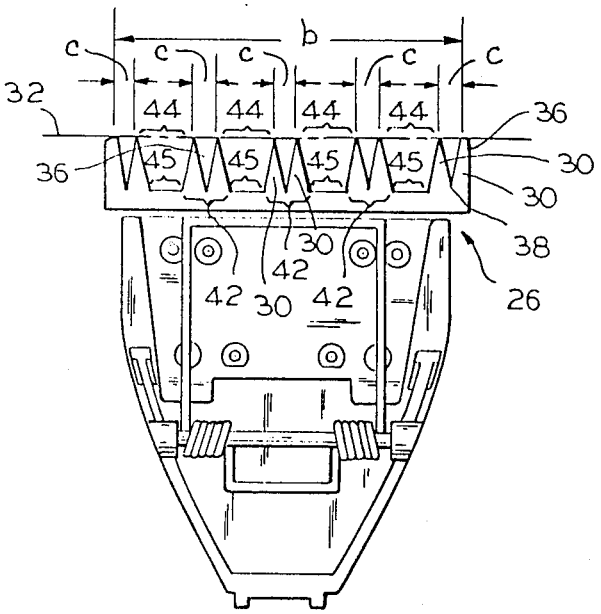
FIG. 7 is a top plan view of the stationary blade of the cutting head of FIG. 2, with the reciprocating blade removed.
Figure 17:
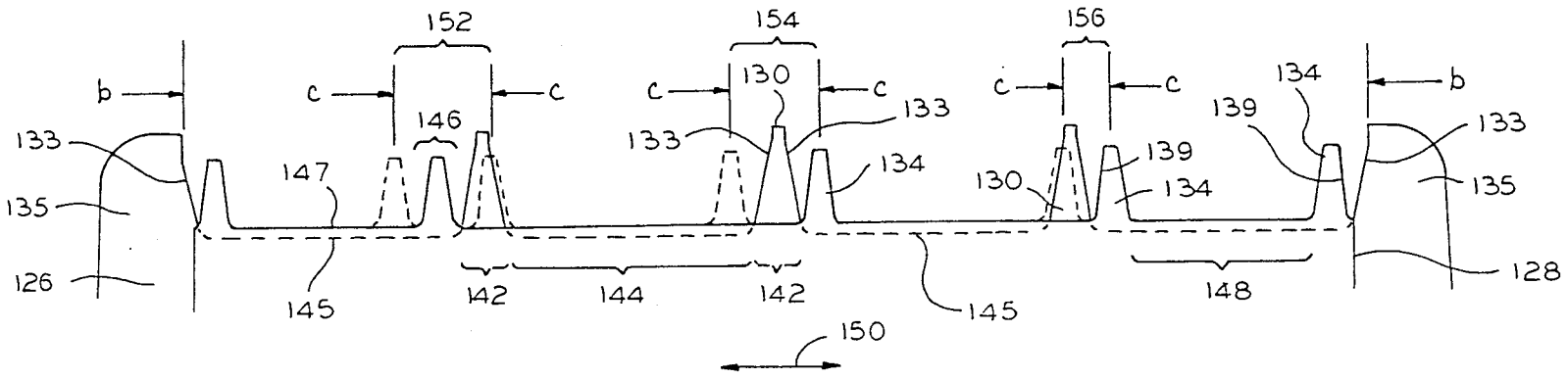
FIG. 17 is a partial view of yet another alternate embodiment of the apparatus of FIG. 1.

The stationary teeth 30 are segregated into a plurality of groups 42, as shown in FIG. 7. Each group 42 may include one or more stationary teeth 30, but one tooth per group, as in FIG. 17, is preferred. The groups 42 are each separated by a space 44. The spaces 44 have bottoms 45 which are smooth and unobstructed, and may be substantially straight, as in FIG. 7, or curved as desired.

Figure 9:
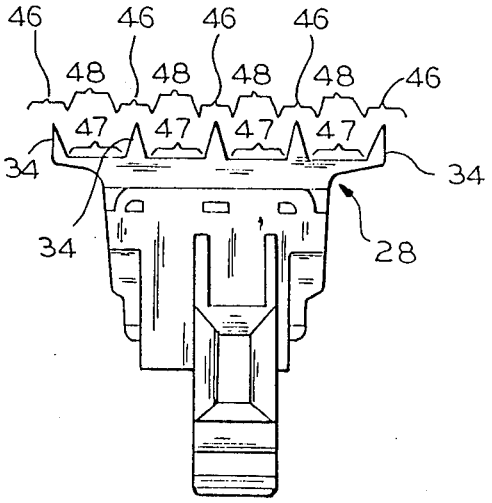
FIG. 9 is a top plan view of the reciprocating blade of the cutting head of FIG. 2, with the reciprocating blade removed from the stationary blade.

The teeth 34 are arranged in a plurality of clusters 46 (FIG. 9), so that one reciprocating tooth 34 crosses each cavity 36, or one or more cutting edges 33 (FIG. 17), as the blade 28 reciprocates. If each group of stationary teeth 30 consists of only one tooth, as in FIG. 17, or forms only one cavity 36, as in FIG. 7, then only one tooth 34 is needed for each cluster 46, as in FIG. 9.

The clusters 46 are separated from each other by gaps 48. The gaps 48 are arranged so that the spaces 44 are substantially unobstructed by the reciprocating teeth 34. The gaps 48 include gap bottoms 47 which preferably correspond to the bottoms 45, as in FIGS. 2, 3 and 5.

Figure 4:
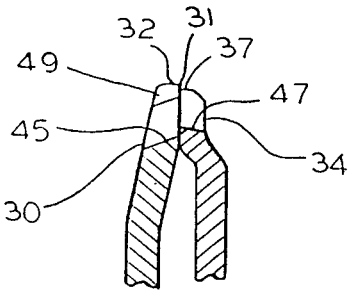
FIG. 4 is a cross section view of a portion of the cutting head shown in FIG. 3, taken along lines 4—4.
Figure 6:
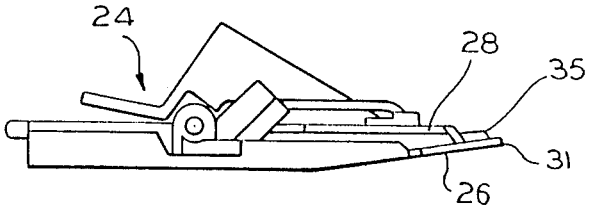
FIG. 6 is a side elevation view of the cutting head of the hair clipper of FIG. 1.

FIG. 4 shows certain aspects of the relationship between the stationary blade 26 and the reciprocating blade 28 in greater detail. The distance between the blade edge 32 and the line 37, and the relatively blunt stationary blade tip 31 are easily seen. As shown in FIG. 4, the gap bottom 47 is slightly closer to the blade edge 32 than the bottom 45, and the gap bottom 47 is a relatively smooth, blunt surface. This structure is desirable so that hair strands which enter the spaces 44 will confront the relatively smooth, blunt surfaces of the gap bottoms 47, and are not damaged by a sharp surface. This could be accomplished in other ways, however. For example, the bottom 45 could be made closer to the blade edge 32 than the gap bottom 47, and the bottom 45 could have a relatively smooth, blunt surface, or the bottoms 45, 47 could be coextensive and both have relatively smooth, blunt surfaces.

Figure 8:
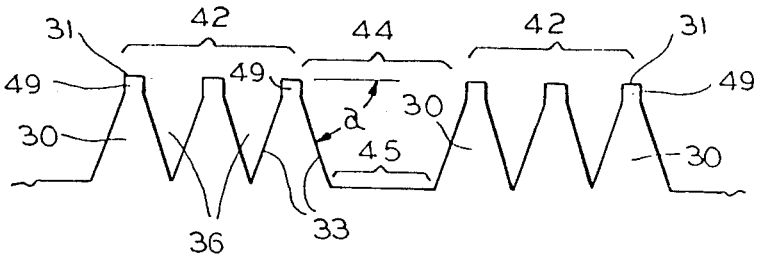
FIG. 8 is a partial view of an alternate embodiment of the stationary blade of FIG. 7.

FIG. 8 shows a portion of an alternate embodiment of the stationary blade 26, in which there are three stationary teeth 30 in each group 42. FIG. 8 also shows an alternate configuration of the stationary teeth 30. The blunt stationary tips 31 can be easily seen. The stationary teeth 30 include a generally rectangular portion 49 adjacent the stationary tips 31. The rectangular portions 49 improve the manner in which hair strands are fed into the cavities 36, and reduce the likelihood that some strands will be pushed away from the teeth 30 when the reciprocating blade teeth 34 (not shown in FIG. 8) pass across the cavities 36. For this reason, it is preferable to provide such rectangular portions on the reciprocating teeth 34, as well.

Each space 44 should have a width along the blade edge 32 which is greater than the distance between adjacent stationary tips 31. The preferred relationship between the groups 42 and the spaces 44 may be described in a general manner by comparing the total linear distance "b" (FIG. 7) along the blade edge 32, which is the distance over which hair strands could encounter and be cut by the blades 26, 28, with the total of the linear distances "c" over which hair strands are likely to enter one of the cavities 36 and be cut. Experiments have shown that good results can be achieved with the embodiment of FIG. 2 when the ratio of the total of the linear distances "c" to the distance "b" is about 0.35 or less, and that the preferred ratio for that embodiment is about 0.2. Experimentation has also shown that finer thinning and better controlled results are achieved by using the embodiment of FIG. 17, which will now be described. Thus, it will be seen that while each of the groups 42 may be made up of multiple teeth, for some applications a single tooth in each group is preferable.

An embodiment in which each group of stationary teeth in the clipper 20 has a single tooth is shown in FIG. 17. A stationary blade 126 and a reciprocating blade 128 are provided which have some structural features which correspond to features of the stationary blade 26 and reciprocating blade 28 which were previously described. The stationary blade 126 has a plurality of stationary teeth 130 which each have at least one cutting edge 133. In addition, ends 135 of the stationary blade 126 may also be provided with a cutting edge 133, if desired.

One reciprocating tooth 134 is provided to complement each stationary tooth 130, and a reciprocating tooth 134 may be provided adjacent each end 135, if a cutting edge 133 is provided. The reciprocating teeth 134 each have one or two cutting edges 139, as needed to properly reciprocate past one of the stationary cutting edges 133.

Each stationary tooth 130 constitutes a group 142, and each group 142 is separated by a space 144 having bottoms 145 which are smooth, unobstructed and substantially straight. Likewise, each reciprocating tooth 134 constitutes a cluster 146, and each cluster 146 is separated by a gap 148 having a gap bottom 147.

The reciprocating blade 128 moves in the directions shown by arrows 150. The manner in which hair strands are cut, and the number of hair strands which are cut with each stroke of the blade 128 will vary, however, according to the manner in which the reciprocating blade 128 moves, and the length of motion of the blade 128. Thus, the linear distance "c" over which hair strands may be cut is shown in three ways in FIG. 17. A first space 152 may be created by causing the tooth 134 to reciprocate between a point which is adjacent to the corresponding tooth 130 and a relatively distant point to the left of the corresponding tooth 130. A second space 154 may be created by causing the tooth 134 in the space 154 to reciprocate between a point to the left of the corresponding tooth 130 and a point to the right of that tooth 130, as also shown in FIG. 17. As another alternative, a third space 156 may be created by causing the tooth 134 in the space 156 to reciprocate between a point adjacent to the corresponding tooth 130 and a point to the right of that tooth. The length of motion of the teeth 134 may also vary, as seen by the different lengths of the spaces 152 and 156. In this manner, the number of hair strands which are cut with each stroke of the reciprocating blade 128 may be controlled as desired. It is contemplated, however, that the manner in which the teeth 134 move will be the same for all teeth 134 in the blade 128.

It should be understood that the distance "c" in FIGS. 2 through 8 is determined primarily by the distance between the tips 31 of stationary teeth 30 in the groups 42, while the distance "c" in FIG. 17 is determined primarily by the space over which the tips of the reciprocating teeth move during operation. In all embodiments, the distance "c" represents the linear distance over which hair strands are likely to be or may be cut. In the embodiment of FIG. 17, it is contemplated that the preferred ratio of the total of the linear distances "c" to the distance "b" is about 0.2. It should be understood, however, that because there is no cavity between stationary teeth, fewer hair strands will be captured and cut. In addition, fewer hair strands will be cut if the reciprocating blade passes across only one cutting edge of the stationary blade.

Figure 3:
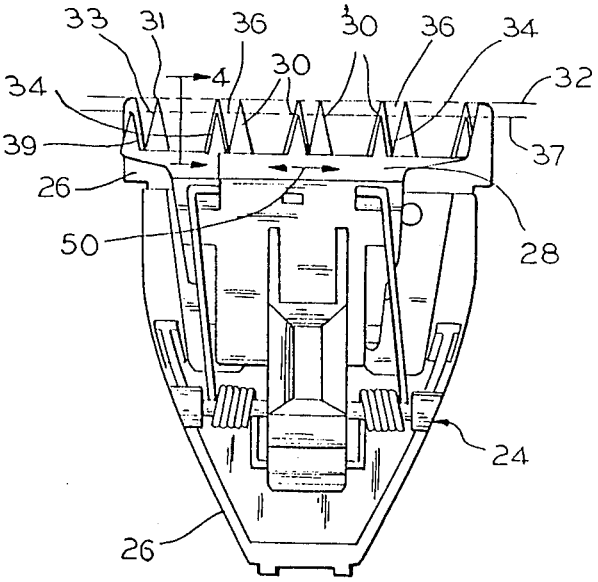
FIG. 3 is another top plan view of the cutting head of the hair clipper of FIG. 1, showing the reciprocating blade on the left side of the head.

In the operation of the embodiments of FIGS. 2 through 8, the oscillating blade 28 travels back and forth in the two directions indicated by arrows 50 in FIG. 3. The reciprocating teeth 34 each travel across one cavity 36, and preferably do not travel much beyond the stationary teeth 30 which form the cavity 36 associated with each reciprocating tooth 34.

The reciprocating blade 28 is shown in FIG. 3 in a position which is about as far to the left as the blade 28 might be expected to travel. As the blade 28 travels to the right, hair strands in the cavities 36 will be cut by the interaction of the cutting edges 39 (FIG. 3) with the cutting edges 33. As the blade 28 travels back to the left, cutting edges 39 on the left sides of the reciprocating teeth 34 will cut hair strands which are in the cavities 36 by interaction with the cutting edges 33 on the left side of the cavities 36.

The operation of the embodiment shown in FIG. 17 is similar to that of the other embodiments shown, except that fewer hair strands will be cut with each stroke of the blade 128, resulting in greater control of the cutting process, and finer thinning of the hair. The use of single teeth permits fewer hair strands to be cut with each stroke, while maintaining an appearance of even, natural cutting, without creating the appearance of gouging or spiking, if desired. Also, by not capturing hair strands in a cavity, the blades move freely through the hair and cut adjacent hair strands different lengths.

The configuration of teeth on the blades 26, 28, or the blades 126, 128 in FIG. 17, in combination with the relatively fast speed and ease of hair cutting which is made possible by electric hair clippers, has led to the development of several new and unique processes for trimming, thinning and layering hair. The processes work especially well on curly and wavy hair, but also work on relatively straight hair.

Figure 11:
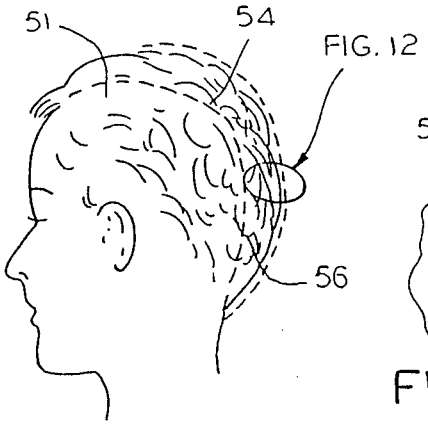
FIG. 11 is an illustration of a person's head and hair.
Figure 12:
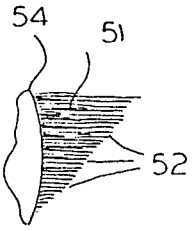
FIG. 12 is an illustration of a portion of the person's head and hair shown in FIG. 11 showing the hair after it has been cut with the hair clipper of FIG. 1.

While the clipper 20 and the processes to be described have many applications, such as grooming animals and the like, the processes will be described with reference to human hair. As seen in FIGS. 11 and 12, hair 51 includes a number of hair strands 52 which grow out of a scalp 54. The hair strands 52 define an outer periphery 56 which is a predetermined distance from the scalp 54. The lay of the hair strands 52, which is their natural tendency to grow in a particular direction, is downwards.

The hair clipper 20 may be used to quickly and neatly trim the hair, if desired. This may be accomplished by stroking the periphery 56 several times in a fairly rapid motion, following the general shape of the hair 50, and gradually moving the clipper 20 so that the clipper is passed over a selected portion of hair being trimmed. The strokes may be up, down, or both up and down. A rate of about one to three strokes per second is expected to produce good, thorough trimmimg in less time than such trimming might take using known methods. This method is particularly useful when it is desired to maintain a particular hairstyle trimmed closer to the head.

Hair may also be trimmed to a different shape using the rapid motion technique just described. When styling the hair, the technique may be used to gradually change the shape of the hair, without abruptly changing it drastically. This allows the operator to sculpt the hair slowly, and critique the style as it evolves. This process is particularly useful for developing new hair styles, and for students studying hair styling.

Figure 10:
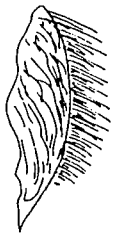
FIG. 10 is an illustration of a portion of a person's head and hair showing the hair after it has been cut with shearing scissors.

In addition to trimming hair, the hair clipper 20 may be used to thin or layer hair. Hand-operated shearing scissors tend to produce distinct layers, even when distinct layers are not desired, as seen in FIG. 10, in part because such scissors cut substantial clusters of hair strands the same length, and also in part because the scissors are held in a substantially fixed position when the hair is cut so that the hair is not pulled.

Distinct layers are most visible when the hair is straight, but they may also be visible when the hair is curly or wavy.

With the hair clipper of this invention, the hair may be thinned by moving the clipper 20 through the hair 50 with the relatively quick, fluid motion previously described. If desired, however, instead of following the shape of the hair, the clipper may be moved in towards the scalp 54, and away from the scalp 54 at the same or a different angle, cutting hair strands 52 in the manner shown in FIG. 12. The resultant texture of the hair 50 is natural and soft, in contrast to the relatively unnatural, coarse texture often obtained using shearing scissors.

Figure 13:
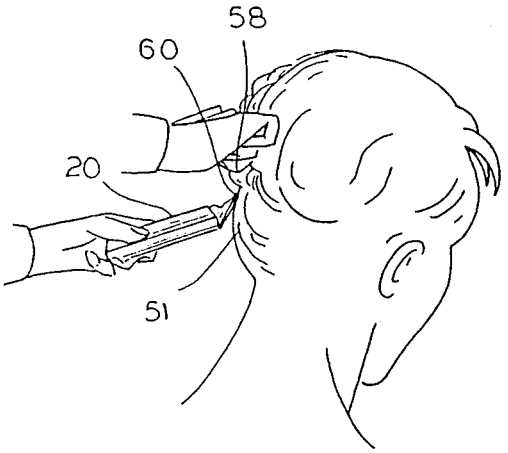
FIG. 13 is an illustration of a person's hair being cut according to one method of the present invention.
Figure 14:
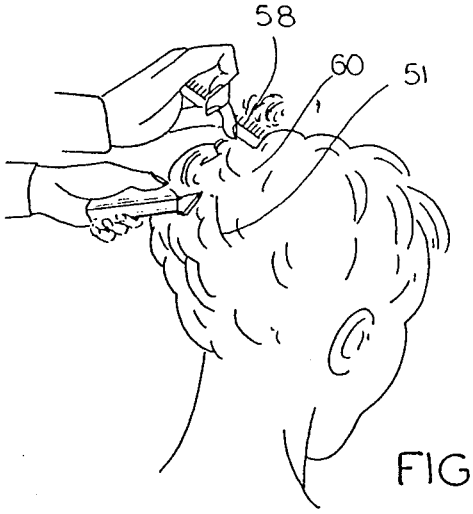
FIG. 14 is another illustration of a person's hair being cut according to the method shown in FIG. 13.
Figure 15:
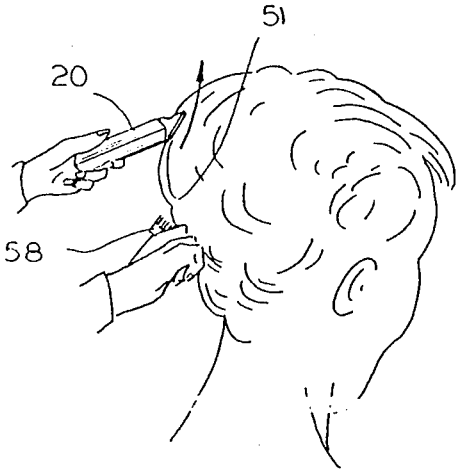
FIG. 15 is still another illustration of a person's hair being cut according to the method shown in FIG. 13.

FIGS. 13, 14 and 15 illustrate another method of clipping hair using the electric clipper 20 of FIG. 1. As seen in FIG. 13, the operator holds the clipper 20 in one hand, and a comb 58 in the other hand. The comb 58 is passed through a portion of the hair 50 with a brisk, continuous motion, preferably upward, against the natural lie of the hair. The comb 58 displaces hair strands as it passes through the hair 50, and creates a wave-like trough 60 which travels behind the comb 58. The clipper 20 follows the comb 58, as in FIGS. 13 and 14, and catches and clips hair strands as they return to their natural position. The clipper may be passed through the hair following the contour of the scalp 54, or it may be passed through the hair at an angle to the scalp 54, cutting the hair as in FIG. 12.

As the comb 58 leaves the hair 50, the comb may be returned to the lower part of the head, for another pass through the hair 50, if desired. The comb 58 may begin a new pass as the clipper 20 finishes the previous pass (FIG. 15), if desired, so that a fairly continuous motion may be used to cut the hair. About one to three passes per second are contemplated as a typical pace. In this manner, the hair may be thinned or layered relatively quickly. Since the clipper 20 cuts a relatively low number of hair strands per cycle, there is little chance that a grave error will occur on any particular pass.

Figure 16:
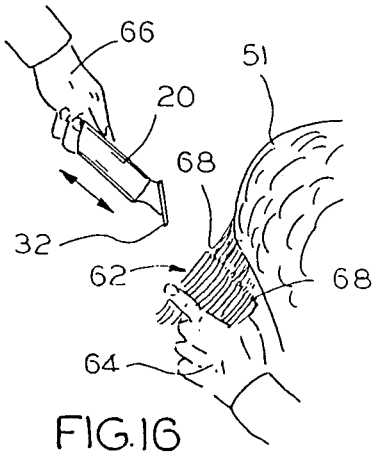
FIG. 16 is an illustration of a person's hair being cut according to another method of the present invention.

Another process which may be used with the hair clipper 20 is known as spiking or notching. As seen in FIG. 16, a tuft of hair 62 is held relatively firmly in place with one hand 64, while the other hand 66 moves the hair clipper 20 into the tuft 62 generally perpendicular to the tuft 62. The hair clipper 20 cuts a plurality of fairly distinct notches 68 in the hair. The hair clipper 20 may be pushed into the tuft 62 any desired number of times and in any desired manner, to create randomly different hair lengths, resulting in a variety of hair styles. The repetition rate can be between about one to three cuts per second.

The many advantages of this invention are now apparent. The hair clipper may be used to trim, thin or layer hair with or without producing distinct, differentiated layers of hair, depending on the embodiment used, and without tearing or otherwise damaging hair strands which are not intended to be cut. The hair clipper may also be used to notch the hair in a variety of ways relatively easily and quickly. The reduced number of teeth cut a relatively low number of hair strands at a time, giving the operator added freedom of movement with less risk of irreparable error. The relatively blunt ends of the teeth provide an added degree of safety.

The processes taught for trimming hair are not excessively tedious and time-consuming, and generally do not require a high level of skill. Hair can be removed easily, without changing the general shape of the hair, or the shape of the hair can be changed gradually, and sculpted into a new style. The thinning and layering processes disclosed result in a natural, fluffy, filigreed texture. The notching processes result in a variety of unique hair styles.

The embodiment shown in FIG. 17 has some advantage over the other embodiments shown and described. By using a single tooth for each group of stationary teeth, finer, better controlled trimming may be obtained, without reducing the total number of groups of teeth on the stationary blade. The hair is not as visibly notched, but can be spiked to produce a soft, gentle appearance.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. Apparatus for clipping hair comprising:

a handle and a cutting head secured to said handle, said handle having a source of electrical power, an electric motor and drive means operatively connecting said motor to said cutting head;

said head comprising a stationary blade and a reciprocating blade operatively connected to said drive means to reciprocate with respect to said stationary blade during operation;

said stationary blade having a set of stationary teeth arranged in a row, said stationary teeth each having at least one cutting edge and a tip, said tips defining a blade edge; each of said stationary teeth being separated from adjacent said stationary teeth by a substantially unobstructed space;

said reciprocating blade having a plurality of reciprocating teeth complementing said stationary teeth so that one of said reciprocating teeth passes one of said cutting edges of said stationary blade teeth;

said reciprocatinf teeth being separated from each other by substantially unobstructed gaps, said gaps being arranged so that a substantially portion of each of said spaces is substantially unobstructed by said reciprocating teeth;

said stationary blade defining a total distance "b" over which hair strands could encounter said blades, and said reciprocating teeth defining a plurality of spaced linear distances "c" over which hair strands are likely yo be cut, the ratio of the sum of said distances "c" to said distance "b" being less than about 0.2.

* * * * *

UNITED STATES PATENT AND TRADEMARK OFFICE

CERTIFICATE OF CORRECTION

PATENT NO. : 4,782,592

DATED : November 8, 1988

INVENTOR(S) : Nicolo Altamore

It is certified that error appears in the above-identified patent and that said Letters Patent is hereby corrected as shown below:

Column 1, lines 57-58, change "pass however" to --pass through the cavities between the unselected teeth, however,--.

Column 2, line 51, change "timeconsuming" to --time-consuming--.

Column 10, line 42, change "reciprocatinf" to --reciprocating--.

Signed and Sealed this

Twenty-eighth Day of March, 1989

*Attest:*

DONALD J. QUIGG

*Attesting Officer*

*Commissioner of Patents and Trademarks*